US007080826B2

(12) United States Patent
Pöckl et al.

(10) Patent No.: US 7,080,826 B2
(45) Date of Patent: Jul. 25, 2006

(54) WINCH FOR A CONSTRUCTION MACHINE

(75) Inventors: Rudolf Pöckl, Schrobenhausen (DE); Martin Lanzl, Ingolstadt (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 0 days.

(21) Appl. No.: 10/935,230

(22) Filed: Sep. 8, 2004

(65) Prior Publication Data

US 2005/0056819 A1 Mar. 17, 2005

(30) Foreign Application Priority Data

Sep. 17, 2003 (DE) ..... 103 43 079

(51) Int. Cl.
*B66D 1/00* (2006.01)

(52) U.S. Cl. ..... 254/332

(58) Field of Classification Search ..... 254/323, 254/329, 332
See application file for complete search history.

(56) References Cited

U.S. PATENT DOCUMENTS

| | | | | |
|---|---|---|---|---|
| 3,524,606 | A * | 8/1970 | Coski | 242/484.2 |
| 3,690,409 | A * | 9/1972 | Brauss | 182/142 |
| 4,002,321 | A | 1/1977 | Shaw et al. | |
| 4,356,557 | A * | 10/1982 | Bell et al. | 702/163 |
| 5,246,181 | A * | 9/1993 | Straub et al. | 242/399.2 |
| 5,975,499 | A * | 11/1999 | Ostrobrod | 254/332 |
| 6,027,103 | A * | 2/2000 | Painter | 254/332 |
| 6,138,992 | A * | 10/2000 | Bell | 254/326 |
| 6,152,425 | A * | 11/2000 | Boyer | 254/323 |
| 6,386,514 | B1 * | 5/2002 | Ray | 254/323 |
| 6,494,437 | B1 * | 12/2002 | Boyer | 254/323 |
| 6,523,806 | B1 * | 2/2003 | Bartal | 254/323 |

FOREIGN PATENT DOCUMENTS

| | | |
|---|---|---|
| DE | 101 13 561 | 9/2002 |
| FR | 2 278 619 | 2/1976 |
| GB | 882 874 | 11/1961 |
| GB | 1 249 405 | 10/1971 |
| GB | 2 132 971 | 7/1984 |
| GB | 2 296 001 | 6/1996 |
| WO | WO 03/053821 | 7/2003 |

* cited by examiner

*Primary Examiner*—Emmanuel M Marcelo
(74) *Attorney, Agent, or Firm*—Jacobson Holman PLLC

(57) ABSTRACT

The invention relates to a winch for a construction machine having a cable drum for receiving a cable and a winch support on which the cable drum is mounted in rotary manner about a rotation axis. The cable drum is swivellably mounted about a swivel axis with respect to the winch support and said axis is directed transversely to the cable drum rotation axis. The invention also relates to a construction machine with a winch and a method for operating a winch.

33 Claims, 3 Drawing Sheets

WINCH FOR A CONSTRUCTION MACHINE

Figure 1:
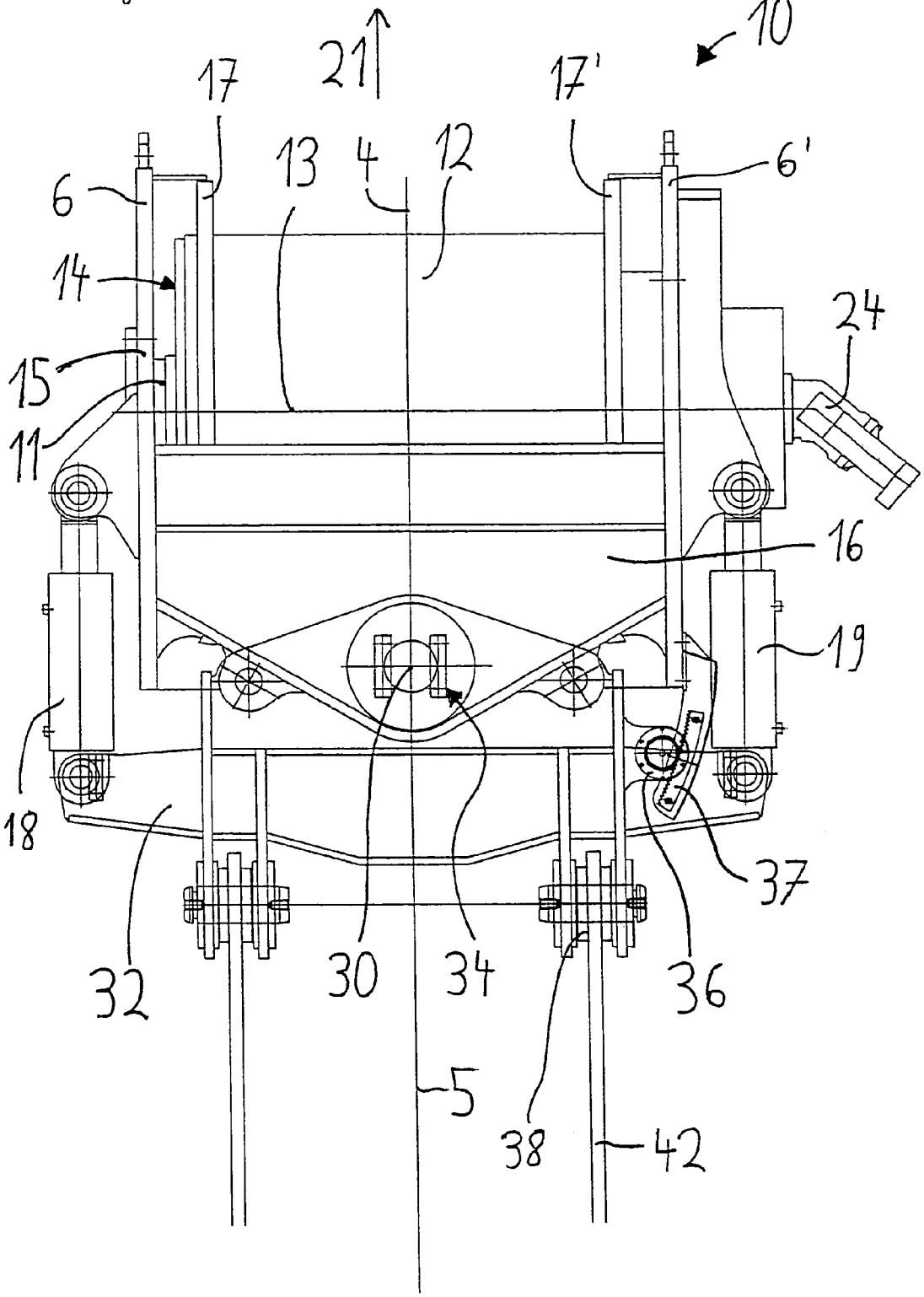

The invention relates to a winch for a construction machine having a cable drum for receiving a cable and a winch support on which the cable drum is mounted in rotary manner about a rotation axis.

The invention also relates to a construction machine having a structure, a mast located on the structure and a cable which is guided on the mast. The invention finally relates to a method for operating a winch.

Construction machines are known which have a soil working tool, e.g. a soil auger, a displacement drill, soil mixing rods and/or drill rods, which is guided on a mast and carried by a hoisting cable, a cable winch being provided for driving the latter. For making sloping holes, particularly when producing batter piles, the mast of such construction machines can be inclinable with respect to a longitudinal axis of a superstructure defined in a transverse direction about an inclination angle. Such a mast inclination can lead to a position change of the hoisting cable with respect to the superstructure, which can lead to bending stressing of the hoisting cable on running into the cable winch.

More particularly when using heavy soil working tools, large winch tensile forces are required and this leads to the use of stronger cables. Such cables frequently have a limited elasticity, so that the bending stress due to the mast inclination on running into the winch can lead to unacceptable cable wear or even to operation with a critical loading with the mast inclined.

The object of the invention is to provide a winch for a construction machine, a method for operating such a winch and a construction machine, which permit a reduction of wear and loading of the cable during construction machine operation.

From the apparatus standpoint this object is achieved by a winch having the features of claim 1 and a construction machine having the features of claim 10. From the method standpoint, the problem is solved by a method having the features of claim 14. Preferred embodiments are given in the dependent claims.

A winch for a construction machine according to the invention is characterized in that the cable drum is swivellably mounted about a swivel axis relative to the winch support and said axis is directed transversely to the rotation axis of the cable drum.

A fundamental idea of the invention is to swivellably mounted about a swivel axis the cable drum with respect to a part of the construction machine and in particular a superstructure, the swivel axis forming with the rotation axis an angle differing from zero. As a result the cable drum is given a further degree of freedom making it possible to adapt the rotation axis of the cable drum to a variable cable position. A planned swivelling of the cable drum makes it possible to extensively optimize to the cable drum a cable running in angle. Appropriately the cable running in angle is chosen in such a way that a bending angle of the cable on running into the cable drum is small and consequently the bending stress and wear of the cable are reduced. As a result of the swivellability of the cable drum it is in particular possible to compensate a change to the cable running in angle on inclining the construction machine mast in the transverse direction with respect to the cable path. This ensures a particularly reliable winding up of the cable in the case of a single or multiple layer winding and simultaneously a particularly low cable wear. In principle, the angle between the swivel axis and the rotation axis can be an acute or obtuse angle. Appropriately the angle between the swivel axis and rotation axis is approximately 90°. This permits a symmetrical construction of a mounting or bearing of the cable drum, which is particularly suitable for absorbing high cable tensile forces, such as can occur during the operation of the construction machine. Preferably the swivel axis is roughly perpendicular to a cable running in plane in which the cable moves, particularly during an inclination movement of the mast and/or during the winding on and/or off of the cable with respect to the cable drum. With such an arrangement the cable running in angle can be optimized in the case of particularly small swivel angles of the cable drum about the swivel axis.

A further development of the winch according to the invention is characterized in that the cable drum is mounted in rotary manner in a winch frame, which can be swivelled with respect to the winch support. Such an arrangement can particularly readily absorb high winch and cable tensile forces. Appropriately the winch frame is mounted on the winch support by means of a swivel joint. Such a swivel joint can be used for absorbing a significant proportion of the winch tensile forces, so that a swivelling of the cable drum about the swivel axis is possible with a particularly low force expenditure. There are preferably two swivel joints along the swivel axis for mounting the winch frame on the winch support.

In a particularly advantageous embodiment of the invention the swivel axis is displaced with respect to the rotation axis and is in particular located outside the cable drum. Such an arrangement allows a particularly compact construction of the winch with reduced leverage in the swivel joint.

According to the invention it is also advantageous that the swivel joint is positioned centrally below the cable drum. The swivel joint can in particular be placed in a cable running below the cable drum. A central arrangement of the swivel joint preferably exists with respect to two faces of the cable drum. Alternatively or additionally the swivel joint can also be positioned centrally with respect to a circumference of the cable drum along the swivel axis. Such an arrangement is particularly suitable for absorbing high cable tensile forces.

It is also appropriate according to the invention for there to be a swivel measuring device for measuring a swivel, particularly a swivel angle of the cable drum with respect to the winch support. Appropriately the swivel measuring device has a control value indicator and/or an incremental indicator.

In order to ensure a particularly reliable winding on and/or off of the cable accompanied by low cable wear, according to the invention it is preferable to provide an actuator for the active swivelling of the cable drum about a swivel axis.

The actuator can e.g. have a gear, which converts a mast inclination in mechanical manner into a swivel angle. However, in particularly preferred manner the actuator has at least one hydraulic cylinder, which can on the one hand be articulated to the winch frame and on the other to the winch support. This makes available a particularly reliable, low maintenance actuator. The actuator preferably has two hydraulic cylinders, which are in particular articulated to the winch frame on either side of the two faces of the cable drum. Such a bilateral arrangement of hydraulic cylinders particularly acting counter to one another permits a particularly reliable and safe pivoting of the cable drum in the case of high cable tensile forces.

A particularly usable embodiment of a winch according to the invention is characterized in that a length measuring device is provided for measuring a cable length wound on and/or off with respect to the cable drum. In the case of known winch and/or cable dimensions, conclusions can be drawn from such a cable length measurement with respect to the position of a winding, i.e. a cable running in point, with respect to a longitudinal axis of the cable drum. This in turn makes it possible to determine the instantaneously optimum swivel angle and the cable drum can be correspondingly swivelled by means of the actuator. This makes it possible to achieve a particularly low wear winding of the cable, even in the case of particularly wide cable drums.

According to a further development of the invention, a particularly precise swivelling of the cable drum results from a control device being provided for controlling the actuator and which is in particular linked with the swivel measuring device. For a particularly effective optimization of the cable running in angle, the swivel measuring device can be alternatively or additionally connected to the length measuring device.

The cable according to the invention can in principle be any filamentary product, including a wire, cable or hose. However, it is appropriately a supporting or hoisting cable for the construction machine. In particular, the cable has a metallic material, preferably steel. Advantageously the cable circumference is roughly circular and/or has a roughly constant diameter over the cable length, said diameter being typically approximately 40 mm. The winch according to the invention is advantageously a free wheel or gravity winch with residual tackle and/or dragline mechanism.

With regards to the construction machine, the invention is characterized in that a winch according to the invention is provided for winding on and/or off the cable.

According to a further development of the construction machine according to the invention an inclining device is provided with which the mast can be inclined with respect to the structure transversely and in particular with respect to a cable running direction and/or an axis passing through the mast and the structure. Such an inclining device makes it possible to incline the mast with respect to the structure with a banking angle of up to 10° and preferably up to 5° and produce borings and optionally piles with a corresponding inclination with respect to the horizontal.

It is also preferable according to the invention for there to provide an inclination measuring device for measuring a slope of the mast with respect to the structure and which is connected to a control device of the winch actuator. The actuator can be used for the inventive swivelling of the cable drum. This makes possible a slope angle-dependent swivelling of the cable drum about a swivel axis in such a way that bending stress of the cable on running into the cable drum is greatly reduced.

In order to make available particularly high cable tensile forces, it is preferable according to the invention to place the winch on the structure. Appropriately the winch is placed on a part of the structure which is not inclinable with respect to said structure by the inclining device.

With regards to the method, the invention is characterized in that a control of the actuator for swivelling the winch cable drum takes place as a function of a sloping of a mast relative to a structure. Such a control more particularly brought about by a control device makes it possible to reduce a bending stress of a cable guided on the mast on running into the cable drum and also reduce cable wear.

Appropriately the actuator is controlled in such a way that a running in angle of the cable into the cable drum during cable winding on and/or off assumes a specific value. This value is advantageously determined in such a way that a bending angle and consequently the bending stress are as low as possible when the cable runs into the cable drum. The value can be dependent on an inclination angle under which the cable is wound onto the cable drum and which in the case of a first cable layer can be determined by grooves formed on the cable drum. The value is appropriately 3 to 4° with respect to a perpendicular to the cable drum rotation axis. The value can also be dependent on the position of the cable winding along a cable drum longitudinal axis. Preferably the actuator is controlled as a function of the cable length wound on and/or off the cable drum, because it is possible to determine from the cable length the position of the next winding along the cable drum.

The invention is described in greater detail hereinafter relative to preferred embodiments and the attached diagrammatic drawings, wherein show:

FIG. 1 A part sectional front view of a winch according to the unswivelled state.

Figure 2:
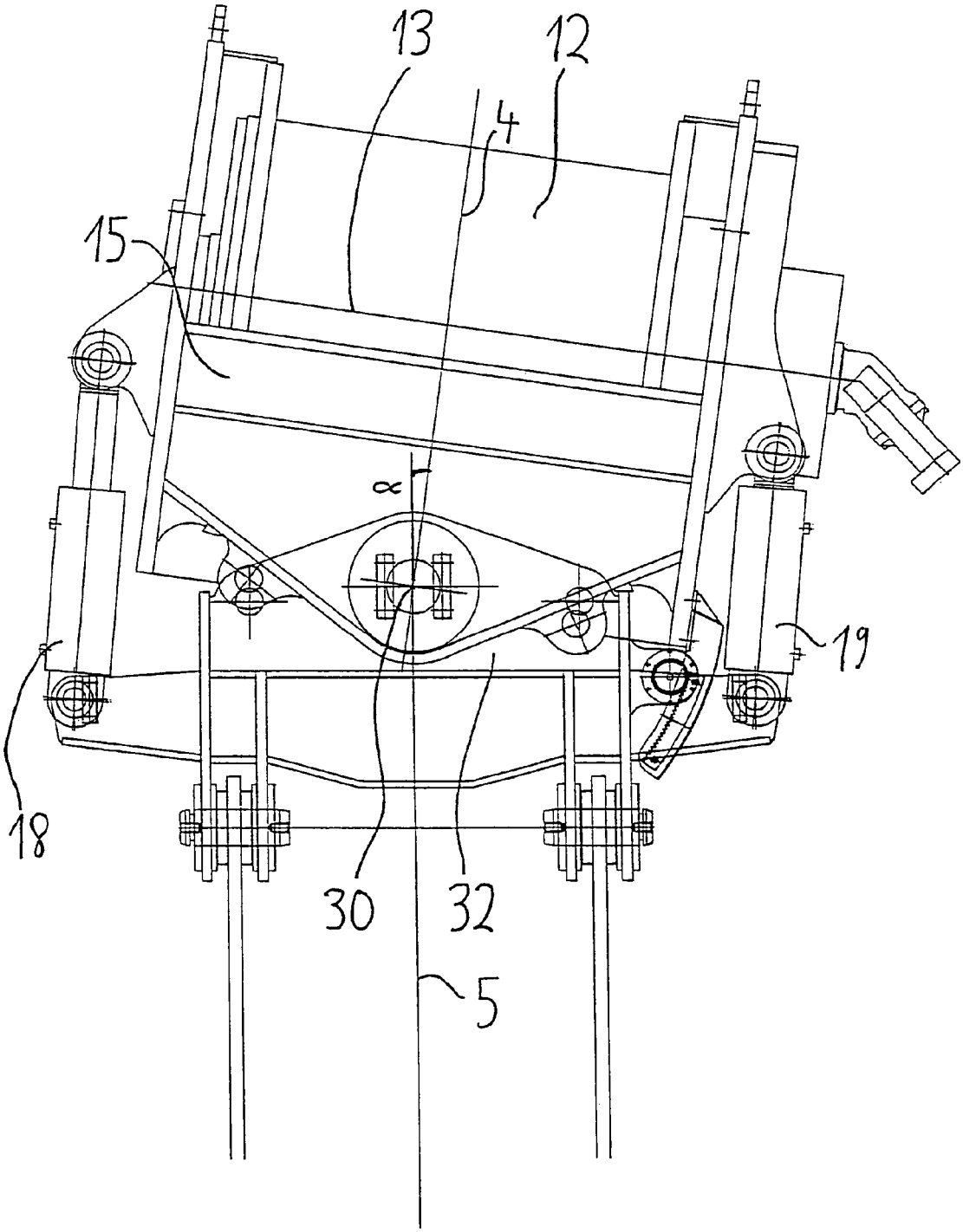

FIG. 2 A part sectional front view of the winch of FIG. 1 in a swivelled state.

Figure 3:
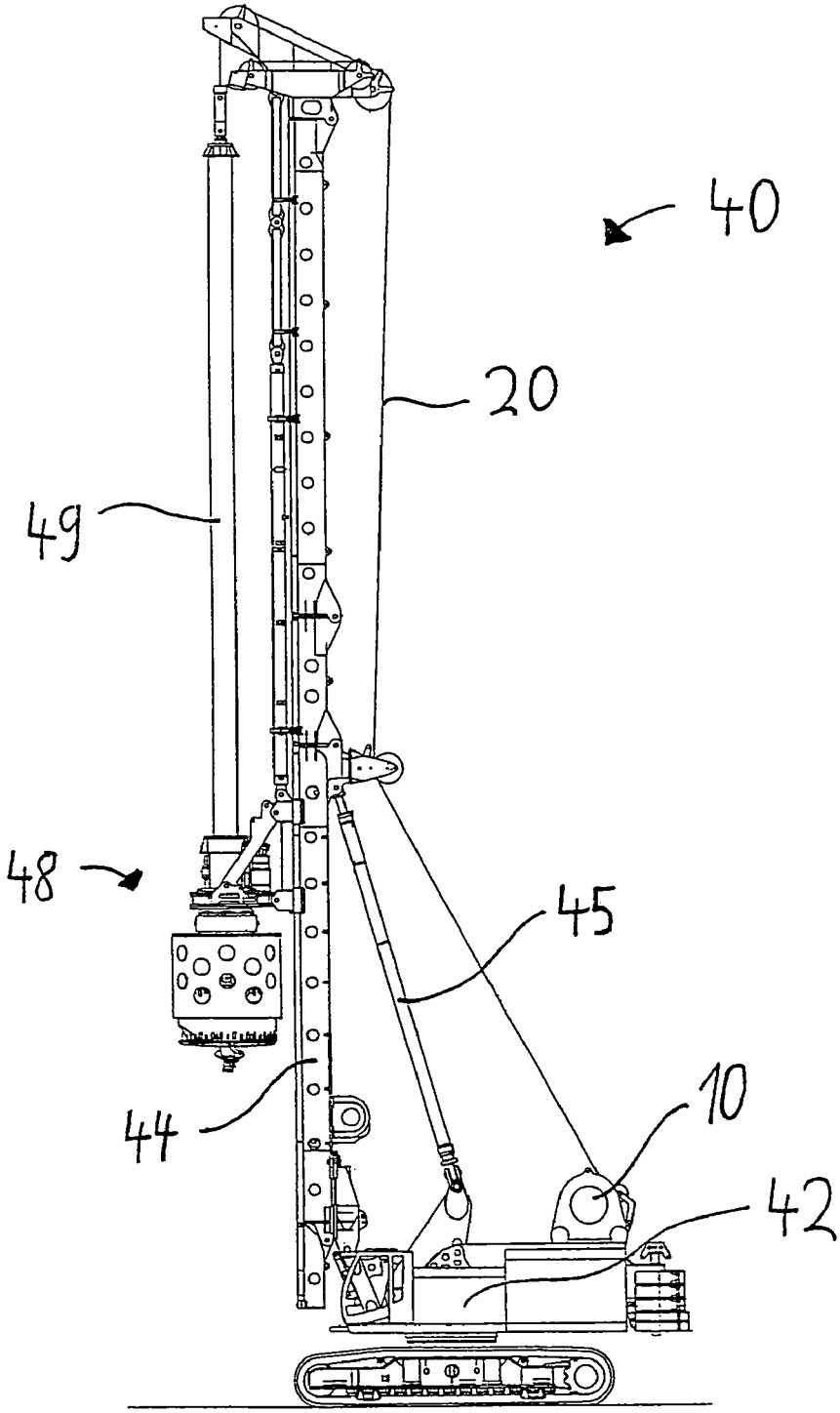

FIG. 3 A side view of a construction machine with a winch according to the invention.

FIGS. 1 and 2 show a winch 10 according to the invention. The winch 10 has a cylindrical cable drum 12 for receiving a cable 20 shown in FIG. 3. Close to its faces 14 are formed on said cable drum 12 circular annular reel walls 17, 17' for laterally bounding the windings of cable 20. The cable drum 12 can be driven in rotary manner about a rotation axis 13 by means of a drive motor 24, said rotation axis 13 coinciding with the longitudinal axis of the cylindrical cable drum 12. The cable 20, not shown in FIGS. 1 and 2, unwound from the cable drum 12 runs roughly in the drawing plane of FIGS. 1 and 2 and roughly in the direction indicated by the arrow 21.

The faces 14 of the cable drum 12 are mounted in rotary manner about rotation axis 13 on a winch frame 15 by means of bearings 11. The winch frame 15 embraces the cable drum 12 in fork-like manner. For this purpose the winch frame 15 has two projecting side elements 6, 6', which are interconnected by a sheet metal as a bracket 16 of the winch frame 15 essentially running in the drawing plane. The bracket 16 can form a plane in which the rotation axis 13 is also located. There can also be two brackets 16 on either side of the cable drum 12.

The winch frame 15 at its bracket 16 is swivellably articulated by means of a swivel joint 34 about a swivel axis 30 to a winch support 32. The swivel axis 30 is roughly perpendicular to the drawing plane of FIGS. 1 and 2 and passes centrally through the swivel joint 34 constructed as a plain bearing.

The swivel axis 30 is both in a symmetry axis 4 of the cable drum 12 and also in a symmetry axis 5 of the winch support 32, both symmetry axes 4, 5 running perpendicular to the drawing plane in FIGS. 1 and 2.

Frontally and on either side of the cable drum 12 in each case one hydraulic cylinder 18, 19 is placed on the winch frame. The piston rods of the hydraulic cylinders 18, 19 are articulated to the side elements 6, 6' and their piston casing are articulated to the winch support 32. In the state of the winch 10 in FIG. 1 the piston rods of the hydraulic cylinders 18, 19 are extended by the same length from the piston casings and the cable drum 12 is in an unswivelled state with respect to the winch support 32. In the state shown in FIG. 2, the piston rod of the hydraulic cylinder 19 is inserted to the greatest possible extent about an insertion path compared with the unswivelled state of the cable drum 12 and the piston rod of the hydraulic cylinder 18 is further extended by this insertion path compared with the unswivelled state, so that the rotation axis 13 of the cable drum 12 is swivelled by the swivel angle α about the swivel axis 30 with respect to the winch support 32.

For determining the swivel angle α on the winch support 32 is provided a control value indicator 36 constructed in the form of an incremental indicator and which can be operated by means of a rack 37 on the side element 6'.

The winch support 32 is connected by means of lockable joints 38 with an only partly shown structure 42.

FIG. 3 shows a construction machine 40 in the form of a drilling implement. The construction machine 40 has a structure 42 equipped with a tracklaying gear and constructed as a superstructure and to the front of which is articulated a mast 44. A drilling device 48 is displaceably placed on the mast and is provided with drill rods 49. The upper end of the drill rods 49 is suspended on a cable 20 which, by means of several guide rollers or pulleys on mast 44, runs to winch 10, which is spaced from the mast 44 on the structure 42. The winch 10 is constructed as the main winch and is able to take up loads of more than one hundred tonnes.

V-shaped inclining cylinders 45 of an inclining device are articulated on the one hand to mast 44 and on the other to structure 42 and as a result the mast 44 can be inclined transversely to the drawing plane with respect to the structure 42. The cable drum 12 can be swivelled with respect to the structure 42 in accordance with the inclination of mast 44.

The invention claimed is:

1. Winch for a construction machine having a cable drum for receiving a cable and a winch support on which the cable drum is mounted so as to rotate about a rotation axis, wherein the cable drum is swivellably mounted about a swivel axis relative to the winch support and said axis is directed transversely to the rotation axis of the cable drum, wherein there is an actuator for the active swivelling of the cable drum about the swivel axis, and wherein the actuator has at least one hydraulic cylinder, which is articulated to the winch frame on either side of two faces of the cable drum.

2. Winch according to claim 1, wherein the cable drum is mounted in rotary manner in a winch frame, which is swivellable with respect to the winch support and is mounted by means of a swivel joint on the winch support.

3. Winch according to claim 2, wherein the swivel joint is positioned centrally below the cable drum.

4. Winch according to claim 1, wherein the swivel axis is displaced with respect to the rotation axis and is located outside the cable drum.

5. Winch according to claim 1, wherein a swivel measuring device is provided for measuring a swivel angle (α) of the cable drum with respect to the winch support and is provided with a control value indicator.

6. Winch according to claim 1, wherein the actuator has two hydraulic cylinders.

7. Winch according to claim 1, wherein there is a length measuring device for measuring a cable length wound at least one of on and off the cable drum.

8. Winch according to claim 1, wherein there is a control device for controlling the actuator and which is connected to at least one of the swivel measuring device and the length measuring device.

9. Construction machine having a structure, a mast located on the structure and a cable guided on the mast, wherein for winding at least one of on and off the cable a winch according to claim 1 is provided.

10. Construction machine having a structure, a mast located on the structure and a cable guided on the mast, wherein for winding at least one of on and off the cable a winch is provided having a cable drum for receiving a cable and a winch support on which the cable drum is mounted so as to rotate about a rotation axis, wherein the cable drum is swivellably mounted about a swivel axis relative to the winch support and said axis is directed transversely to the rotation axis of the cable drum, wherein inclining device is provided for sloping the mast with respect to the structure.

11. Construction machine according to claim 10, wherein the winch is located on the structure.

12. Construction machine according to claim 10, wherein the cable drum is mounted in rotary manner in a winch frame, which is swivellable with respect to the winch support and is mounted by means of a swivel joint on the winch support.

13. Construction machine according to claim 12, wherein the swivel joint is positioned centrally below the cable drum.

14. Construction machine according to claim 10, wherein the swivel axis is displaced with respect to the rotation axis and is located outside the cable drum.

15. Construction machine according to claim 10, wherein a swivel measuring device is provided for measuring a swivel angle (α) of the cable drum with respect to the winch support and is provided with a control value indicator.

16. Construction machine according to claim 10, wherein there is an actuator for the active swivelling of the cable drum about the swivel axis.

17. Construction machine according to claim 16, wherein the actuator has at least one hydraulic cylinder, which is articulated to the winch frame on either side of two faces of the cable drum.

18. Construction machine according to claim 17, wherein the actuator has two hydraulic cylinders.

19. Construction machine according to claim 17, wherein there is a control device for controlling the actuator and which is connected to at least one of the swivel measuring device and the length measuring device.

20. Construction machine according to claim 10, wherein there is a length measuring device for measuring a cable length wound at least one of on and off the cable drum.

21. Construction machine having a structure, a mast located on the structure and a cable guided on the mast, wherein for winding at least one of on and off the cable a winch is provided having a cable drum for receiving a cable and a winch support on which the cable drum is mounted so as to rotate about a rotation axis, wherein the cable drum is swivellably mounted about a swivel axis relative to the winch support and said axis is directed transversely to the rotation axis of the cable drum, wherein there is provided inclination measuring device means for measuring a slope of the mast with respect to the structure and which is connected to a control device of an actuator of the winch.

22. Construction machine according to claim 21, wherein the cable drum is mounted in rotary manner in a winch frame, which is swivellable with respect to the winch support and is mounted by means of a swivel joint on the winch support.

23. Construction machine according to claim 22, wherein the swivel axis is displaced with respect to the rotation axis and is located outside the cable drum.

24. Construction machine according to claim 21, wherein the swivel axis is displaced with respect to the rotation axis and is located outside the cable drum.

25. Construction machine according to claim 21, wherein a swivel measuring device is provided for measuring a swivel angle (α) of the cable drum with respect to the winch support and is provided with a control value indicator.

26. Construction machine according to claim 21, wherein there is an actuator for the active swivelling of the cable drum about the swivel axis.

27. Construction machine according to claim 26, wherein the actuator has at least one hydraulic cylinders, which is articulated to the winch frame on either side of two faces of the cable drum.

28. Construction machine according to claim 27, wherein the actuator has two hydraulic cylinders.

29. Construction machine according to claim 27, wherein there is a control device for controlling the actuator and which is connected to at least one of the swivel measuring device and the length measuring device.

30. Construction machine according to claim 21, wherein there is a length measuring device for measuring a cable length wound at least one of on and off the cable drum.

31. Construction machine according to claim 21, wherein the winch is located on the structure.

32. Method for operating a winch according to claim 1, comprising the step of controlling the actuator for swivelling the cable drum of the winch as a function of a slope of a mast relative to a structure.

33. Method according to claim 32, wherein the actuator is controlled in such a way that a running in angle of the cable into the cable drum assumes a specific value on winding at least one of on and off the cable.

* * * * *